US007239297B2

(12) United States Patent
Tajima et al.

(10) Patent No.: US 7,239,297 B2
(45) Date of Patent: Jul. 3, 2007

(54) IMAGE DISPLAY DEVICE AND METHOD FOR DRIVING THE SAME

(75) Inventors: Akimitsu Tajima, Tokyo (JP); Takashi Nose, Tokyo (JP)

(73) Assignee: NEC Electronics Corporation (JP)

( * ) Notice: Subject to any disclaimer, the term of this patent is extended or adjusted under 35 U.S.C. 154(b) by 181 days.

(21) Appl. No.: 10/212,452

(22) Filed: Aug. 5, 2002

(65) Prior Publication Data

US 2003/0030614 A1 Feb. 13, 2003

(30) Foreign Application Priority Data

Aug. 3, 2001 (JP) ..... 2001-236840

(51) Int. Cl.
*G09G 3/36* (2006.01)
*G09G 5/10* (2006.01)

(52) U.S. Cl. ..... 345/89; 345/690

(58) Field of Classification Search ..... 345/89, 345/690–693

See application file for complete search history.

(56) References Cited

U.S. PATENT DOCUMENTS 5,347,294 A * 9/1994 Usui et al. ..... 345/89
5,844,533 A * 12/1998 Usui et al. ..... 345/89
5,917,471 A 6/1999 Choi ..... 345/147
6,333,727 B2 * 12/2001 Mizumaki ..... 345/89
6,344,843 B1 * 2/2002 Koyama et al. ..... 345/100
6,356,260 B1 3/2002 Montalbo ..... 345/204
6,714,181 B2 * 3/2004 Furuhashi et al. ..... 345/89
2001/0010512 A1 8/2001 Azami ..... 345/100
2001/0038372 A1 * 11/2001 Lee ..... 345/89
2001/0048419 A1 * 12/2001 Stevens ..... 345/89

FOREIGN PATENT DOCUMENTS

| | | |
|---|---|---|
| DE | 19915020 | 4/1999 |
| EP | 0 513 551 | 4/1992 |
| EP | 0 546 780 | 12/1992 |
| EP | 0 533 472 | 3/1993 |
| EP | 0 947 977 | 1/1999 |

* cited by examiner

*Primary Examiner*—Kevin M. Nguyen
(74) *Attorney, Agent, or Firm*—Hayes Soloway P.C.

(57) ABSTRACT

An image display device including a liquid crystal display panel is provided which is capable of achieving reduction of power consumption and EMI (Electromagnetic Interference) by lowering an amount of transfer of digital gray-scale data. To the liquid crystal display panel are connected a display controlling circuit, a scanning line driving circuit, and a signal line driving circuit. If input gray-scale data corresponding to a present line does not match gray-scale data corresponding to a previous line, gray-scale data is output and D/A (digital-analog) converted signal voltage is output. If both the gray-scale data are matched with each other, a matching signal is output to have D/A converted signal voltage be output.

21 Claims, 13 Drawing Sheets

IMAGE DISPLAY DEVICE AND METHOD FOR DRIVING THE SAME

BACKGROUND OF THE INVENTION

1. Field of the Invention

The present invention relates to an image display device for displaying an image signal responsive to digital gray-scale data and a method for driving the image display device, and more particularly to the image display device in which lowering of noise and reduction of power consumption are required to be employed in a flat display device typified by a liquid crystal display (LCD) device.

The present application claims priority of Japanese Patent Application No. 2001-236840 filed on Aug. 3, 2001, which is hereby incorporated by reference.

2. Description of the Related Art

A display device in which a screen is created responsive to digital gray-scale data, such as an LCD device, a plasma display, or a like is widely used. By using a conventional LCD device as an example, configurations and operations of a display device will be described below.

FIG. 11 is a schematic block diagram showing an example of configurations of a conventional LCD device 1. FIG. 12 is a schematic block diagram showing an example of configurations of a conventional signal line driving circuit. FIG. 13 is a timing chart showing operations of a display control circuit and the conventional signal line driving circuit employed in the conventional LCD device 1. FIG. 14 is a diagram conceptually explaining a transfer of gray-scale data used in the conventional LCD device 1.

The conventional LCD device 1, as shown in FIG. 11, includes a display control circuit 3, a scanning line driving circuit 5, and a signal line driving circuit 6, all of which are connected to a liquid crystal panel 2. The liquid crystal panel 2 is so configured that a plurality of gate bus lines (scanning lines) 11 is arranged in a horizontal direction and a plurality of data bus lines (signal lines) 12 is arranged in a vertical direction and, moreover, at every point of intersections of the gate bus lines 11 on each row and the data bus lines 12 on each column are arranged pixel electrodes 13, and between each of the pixel electrodes 13 and each of the corresponding data bus lines 12 are formed TFTs (Thin Film Transistors) 14 and the gate at each of the TFTs 14 is connected to the gate bus lines 11. As shown in FIG. 1, one pixel is so configured that a pixel electrode for a red (R) color, a pixel electrode for a green (G) color, and a pixel electrode for a blue (B) color are sequentially arranged in a horizontal direction and each of the (R, G, B) electrodes is connected to a gate bus line 11 and a predetermined number of such the pixel electrodes 13 is arranged along the gate bus line 11 while a predetermined number of the pixel electrodes 13 for a same color is connected along each of the data bus lines 12 in a vertical direction.

In the display control circuit 3, gray-scale data input for each of the R, G, and B colors is properly sorted in such a manner as to correspond to an arrangement of the pixel in the liquid crystal panel 2 and is output as gray-scale data sorted by changing a position of data to the signal line driving circuit 6 and a control signal for driving a scanning line (gate bus line 11) is output to the scanning line driving circuit 5 and a control signal for driving a signal line (data bus line 12) is output to the signal line driving circuit 6.

The conventional signal line driving circuit 6 chiefly includes, as shown in FIG. 12, a shift register 61 being made up of flip-flops F1, F2, F3, F4, . . . , and Fm, a latch signal outputting section (circuit) 62, a data latch 63, a digital/analog converting section (DAC) 64, and an output controlling section 65.

The shift register 61 is so configured that flip-flops F1, F2, F3, F4, . . . , and Fm corresponding to a number of pixels arranged in a horizontal direction in the LCD device 1 are serially connected which sequentially transmits a latch pulse, in response to a clock, to a back stage. The latch signal outputting section 62 includes each of gate circuits G1, G2, G3, G4, . . . , and Gm being connected to an output terminal of each of the flip-flops F1, F2, F3, F4, . . . , and Fm, each of which is turned ON in response to a gate pulse, and outputs a state of an output from each of the corresponding flip-flops F1, F2, F3, F4 . . . , and Fm as latch signals P1, P2, P3, P4, . . . , and Pm, respectively to the data latch 63.

The data latch 63 latches gray-scale data existing at a position corresponding to each of the pixel electrodes 13 in sorted gray-scale data bus to be fed from the display control circuit 3 in accordance with latch signals P1, P2, P3, P4, . . . , and Pm and produces outputs Q1, Q2, Q3, Q4, . . . , and Qm. The DAC 64 performs digital to analog conversion on a gray-scale signal of each of the inputs Q1, Q2, Q3, Q4, . . . , and Qm and produces DC (direct current) voltage outputs D1, D2, D3, D4, . . . , and Dm and outputs them to each of the pixel electrodes 13. The output controlling section 65 is made up of gate circuits H1, H2, H3, H4, . . . , and Hm and outputs, all at once, DC voltage outputs D1, D2, D3, D4, . . . , and Dm, to each of corresponding data bus lines 12 in response to an output control pulse.

Next, operations of the conventional LCD device 1 are briefly described by referring to FIG. 11 and FIG. 12. The image drawing device (not shown) including a personal computer outputs, for example, gray-scale data being made up of a digital signal for each of the R, G, and B colors. The gray-scale data for each of the R, G, and B colors corresponds to a number of gray levels of an image to be displayed, that is, in the case of, for example, 64 gray levels, the gray-scale data is made up of 6 bits of digitized signals. A vertical sync signal serving as a sync signal is output so as to correspond to a display period for each field and a horizontal sync signal is output so as to correspond to a scanning period for each line.

The scanning line driving circuit 5 scans gate bus lines 11 one by one from above to down. The signal line driving circuit 6 controls, based on gray-scale data having a predetermined strength of light, a voltage level of a data bus line 12 being connected to a corresponding pixel, for each of a plurality of pixels which is in a state of selecting a voltage level of a gate bus line 11. This light in an amount corresponding to gray-scale data to transmit through a pixel being connected to a gate bus line 11 being scanned by the scanning line driving circuit 5.

In the LCD device 1, the display control circuit 3, by sorting gray-scale data in such a manner as to be repeated in order of data for R, G, and B colors for every gate bus line 11 in response to each of the input gray-scale data for the R, G, and B colors and to a sync signal, outputs sorted gray-scale data so as to correspond to an arrangement of pixels in the conventional LCD device 1 and outputs a control signal for driving a scanning line (gate bus line 11) to the scanning line driving circuit 5 according to a sync signal and outputs a control signal for driving a signal line (data bus line 12) to the signal line driving circuit 6.

FIG. 13 is a timing chart illustrating operations of the display control circuit 3 and the signal line driving circuit 6 in the conventional LCD device 1. This shows that the display control circuit 3 always outputs pixel data in response to input pixel data and that the signal driving circuit 6 always performs a latch operation of pixel data.

FIG. 14 is a diagram conceptually explaining transfer of gray-scale data in the conventional LCD device 1. In FIG. 14, display image data on each line is expressed in monochrome (in black and white) for simplification of descriptions. In the case of a color image, "□" shows a display image in a color serving as a reference color and having brightness at a level of a color and "■" shows a display image in a color being different from "□" and having brightness at a level. "0" shows gray-scale data corresponding to image data "■" and "1" shows gray-scale data corresponding to image data "□". As shown in FIG. 14, since gray-scale data are all transferred in a vertical direction regardless of whether there is no correlation (for example, between first line and second line) or there is correlation (for example, between second line and third line), much change in data in the gray-scale data bus occurs accordingly.

Thus, in the conventional LCD device 1, input gray-scale data changes in a manner so as to correspond to a change in a signal output for each of pixel electrodes, regardless of existence of correlation in a vertical direction on a display panel (liquid crystal panel) screen and, therefore, problems occur in that an amount of transmittance data in the gray-scale data bus is large which causes an increase in power consumption associated with gray-scale data transmittance and in EMI (Electro Magnetic Interference) caused by a current change in the gray-scale data bus.

SUMMARY OF THE INVENTION

In view of the above, it is an object of the present invention to provide an image display device which is capable of substantially reducing an amount of gray-scale data to be transferred, based on presence or absence of correlation in a vertical direction of a pixel, and a method for driving the image display device.

According to a first aspect of the present invention, there is provided an image display device including:

a display panel in which a pixel electrode is arranged at every point of intersections of scanning lines and signal lines;

a display control circuit to sort digital gray-scale data so as to correspond to a pixel arrangement in the display panel and to output the sorted digital gray-scale data;

a scanning line driving circuit to sequentially scan the scanning line on each of rows in every scanning period; and a signal line driving circuit to generate a signal voltage responsive to the sorted gray-scale data for each of the signal lines and to feed a produced signal voltage to a corresponding signal line on each column in every scanning period;

wherein the display control circuit has a gray-scale data comparison controlling circuit which produces a matching signal indicating matching or non-matching obtained by a result from comparison between input gray-scale data and gray-scale data provided one scanning period before and exerts control so as to output gray-scale data when the matching signal indicates non-matching and to stop outputting of the gray-scale data when the matching signal indicates matching; and wherein the signal line driving circuit is so configured as to latch, when the matching signal indicates non-matching, input gray-scale data in response to a latch pulse providing driving timing of each of the signal lines and as to produce and output a signal voltage based on the gray-scale data and, when the matching signal indicates matching, as to output a signal voltage based on gray-scale data being latched during the scanning period.

In the foregoing, a preferable mode is one wherein the gray-scale data comparison controlling circuit includes a line memory to hold input gray-scale data and to output it one scanning period later, a comparing circuit to compare input gray-scale data with output gray-scale data stored in the line memory and, when both of them are matched with each other, to output the matching signal, and a data output controlling circuit to stop outputting gray-scale data responsive to matching and non-matching of the matching signal and to produce the gray-scale data.

Also, a preferable mode is one wherein the comparing circuit includes a plurality of exclusive NOR circuits to detect, for every corresponding bit, whether there is matching between input gray-scale data and output gray-scale data stored in the line memory and an AND circuit to output the matching signal based on an AND of an output from a plurality of the exclusive NOR circuits.

Also, a preferable mode is one wherein the data output controlling circuit includes a plurality of flip flops to latch, when the matching signal indicates non-matching, the input gray-scale data for every bit and to update its output.

Also, a preferable mode is one wherein the signal line driving circuit includes shift registers existing at a plurality of stages each sequentially transferring the latch pulse and outputting it to each of the corresponding signal lines, a latch signal outputting section having a plurality of gate circuits mounted responsive to an output from the shift register existing at each stage and outputs, when the matching signal indicates non-matching, signals from the shift register at a corresponding stage as a latch signal, and a data latch to latch a plurality of bits of input gray-scale data for every bit responsive to a latch signal of each of gate circuits and to output it to each of the corresponding signal lines.

According to a second aspect of the present invention, there is provided a method for driving an image display device to perform an image display on a display panel in which a pixel electrode is arranged at every point of intersections of scanning lines and signal lines by producing a signal voltage responsive to digital gray-scale data being sorted so as to correspond to a pixel arrangement of the display panel and by sequentially scanning the scanning line on each of rows and by feeding the produced signal voltage to the signal line at each column, the method including:

a step of producing a matching signal indicating matching or non-matching obtained by a result from comparison between input gray-scale data and gray-scale data provided one scanning period before and by exerting control so as to output gray-scale data when the matching signal indicates non-matching and to stop outputting the gray-scale data when the matching signal indicates matching; and a step of latching, when the matching signal indicates non-matching, input gray-scale data in response to a latch pulse providing driving timing of each of the signal lines and producing a signal voltage based on the gray-scale data and, when the matching signal indicates matching, of producing and outputting a signal voltage based on gray-scale data latched during a previous scanning period.

According to a third aspect of the present invention, there is provided an image display device including:

a display panel in which a pixel electrode is arranged at every point of intersections of scanning lines and signal lines;

a display control circuit to output, sequentially and in parallel, digital gray-scale data for every "i" sets of the gray-scale data being input successively;

a scanning line driving circuit to sequentially scan a scanning line on each of rows in every scanning period;

a signal line driving circuit to generate a signal voltage responsive to the parallel gray-scale data and to feed it for every corresponding "i" sets of signal lines;

wherein the display control circuit has a gray-scale data comparison controlling circuit which produces a matching signal indicating matching or non-matching obtained by a result from comparison between "i" sets of input gray-scale data and "i" sets of gray-scale data provided one scanning period before and exerts control so as to output "i" sets of gray-scale data when the matching signal indicates non-matching and to stop outputting the "i" sets of gray-scale data when the matching signal indicates matching; and wherein the signal line driving circuit is so configured as to latch, when the matching signal indicates non-matching, "i" sets of input gray-scale data in response to a latch pulse providing driving timing of "i" sets of the signal lines and so as to produce a signal voltage based on the gray-scale data and, when the matching signal indicates matching, to output a signal voltage based on "i" sets of gray-scale data latched during the scanning period.

In the foregoing, a preferable mode is one wherein the gray-scale data comparison controlling circuit includes a line memory to hold input gray-scale data and to output it one scanning period later, a comparing circuit to compare input gray-scale data with output gray-scale data stored in the line memory and, when both of them are matched with each other, to output the matching signal, and a data output controlling circuit to stop or perform outputting gray-scale data responsive to matching and non-matching of the matching signal Also, a preferable mode is one wherein the comparing circuit includes a plurality of exclusive NOR circuits to detect, for every corresponding bit, whether there is matching between the input gray-scale data and output gray-scale data stored in the line memory and an AND circuit to output the matching signal based on an AND of an output from a plurality of the exclusive NOR circuits.

Also, a preferable mode is one wherein the data output controlling circuit includes a plurality of flip flops to latch, when the matching signal indicates non-matching, the input gray-scale data for every bit and to update its output.

Also, a preferable mode is one wherein the signal line driving circuit includes shift registers existing at a plurality of stages each sequentially transferring the latch pulse and outputting it to each of a 3i-th signal line, a latch signal outputting section having a plurality of gate circuits mounted responsive to an output from the shift register existing at each stage and outputs, when the matching signal indicates non-matching, signals from the shift register at a corresponding stage as a latch signal, and a data latch to latch a plurality of bits of "i" sets of input gray-scale data for R (red), G (red), and B (blue) colors for every bit responsive to a latch signal of each of gate circuits and to output it to each of the corresponding signal lines.

Also, a preferable mode is one wherein the display is a liquid crystal panel.

According to a fourth aspect of the present invention, there is provided a method for driving an image display device to perform an image display on a display panel in which a pixel electrode is arranged at every point of intersections of scanning lines and signal lines by generating a signal voltage responsive to "i" sets of digital gray-scale data being input in parallel and consecutively and by sequentially scanning the scanning line on each of rows in every scanning period and by feeding a produced signal voltage to the signal line at each column, the method including;

a step of producing a matching signal indicating matching or non-matching obtained by a result from comparison between "i" sets of input gray-scale data and "i" sets of gray-scale data provided one scanning period before and by exerting control so as to output the "i" sets of gray-scale data when the matching signal indicates non-matching and to stop outputting the gray-scale data when the matching signal indicates matching; and a step of latching, when the matching signal indicates non-matching, said "i" sets of input gray-scale data in response to a latch pulse providing driving timing of each of the "i" sets of signal lines, and of producing and outputting "i" sets of signal voltages based on the gray-scale data and, when the matching signal indicates matching, of producing and outputting "i" sets of signal voltage based on "i" sets of gray-scale data latched during a previous scanning period.

In the foregoing, a preferable mode is one wherein the display panel is a liquid crystal panel.

With the above configurations, gray-scale data corresponding to a present line is compared with gray-scale data corresponding to a previous line and, during a section in which both the gray-scale data are matched with each other, an image signal is generated using gray-scale data corresponding to the previous line and, only during a section in which both the gray-scale data are not matched with each other, an image signal is produced using gray-scale data corresponding to a present line and, therefore, an amount of transfer of the gray-scale data can be substantially reduced and, as a result, power consumption of the image display device can be lowered and EMI occurring when gray-scale data is transferred in a bus wiring of a display panel can be reduced. Moreover, the image display device and its driving method of the present invention, when being applied to a case where one or a plurality of signal lines for R, G, and B colors is driven, it is possible to achieve reduction of both power consumption and EMI.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

First Embodiment

Figure 1:
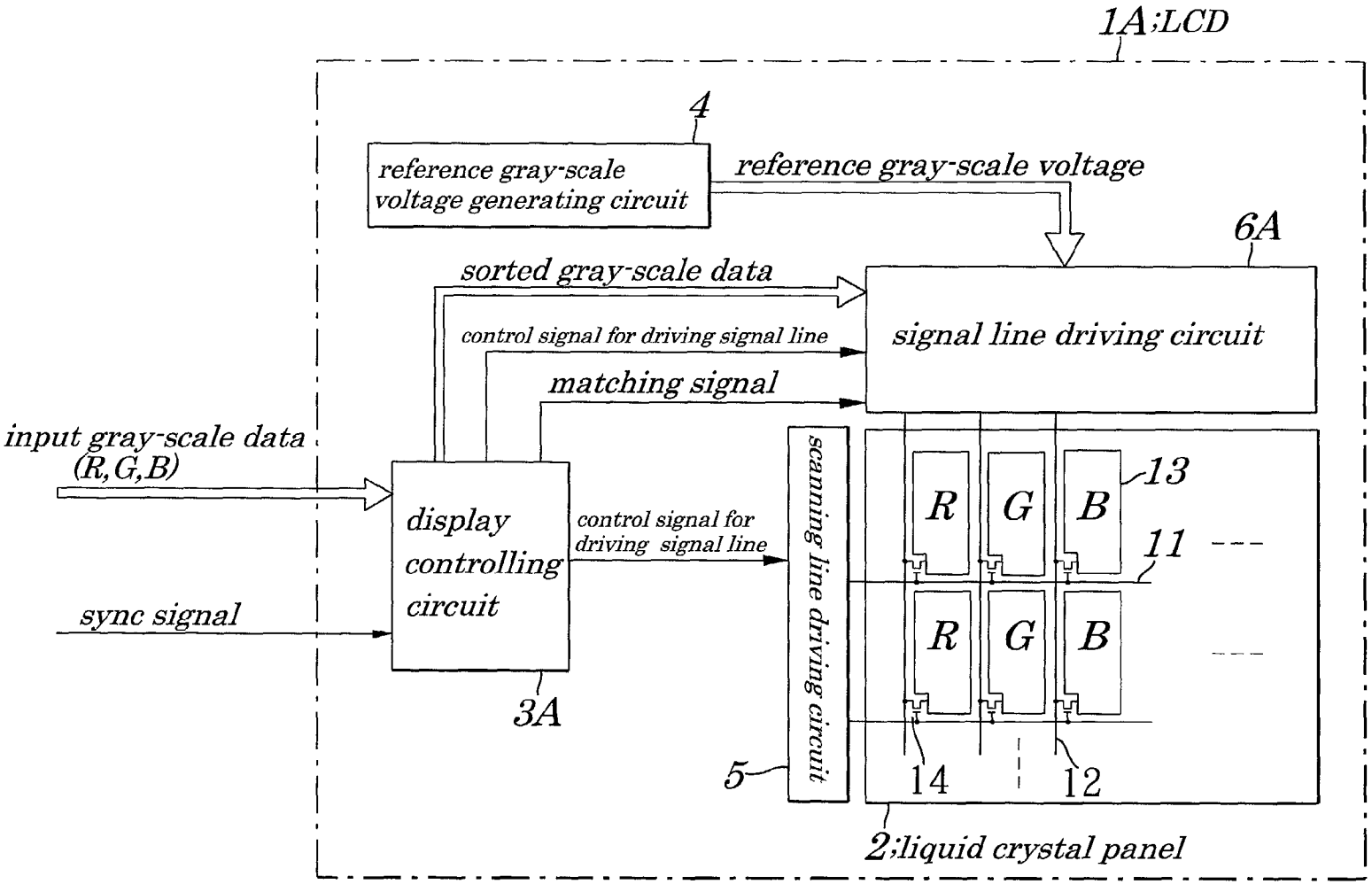
FIG. 1 is a diagram showing configurations of an image display device according to a first embodiment of the present invention.
Figure 2:
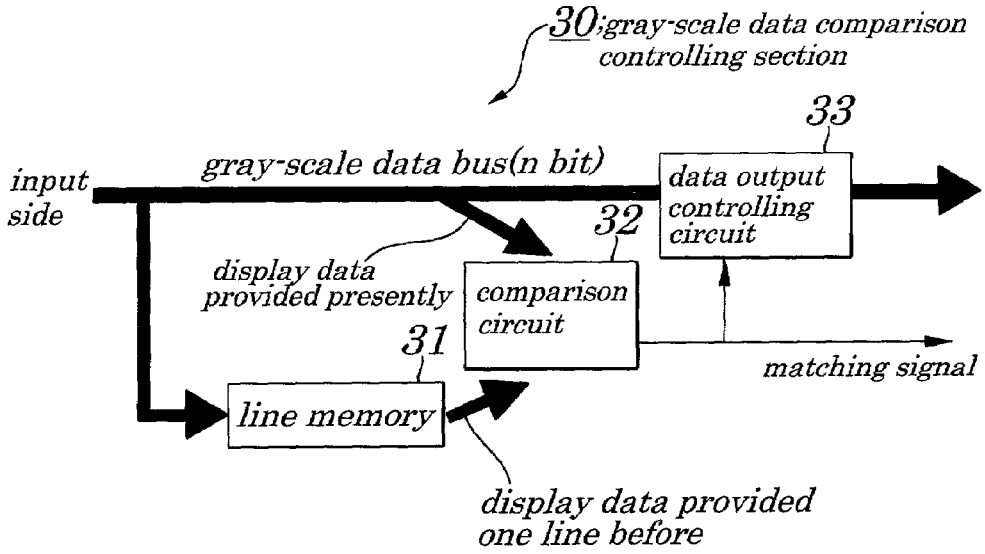
FIG. 2 is a diagram showing configurations of a gray-scale data comparison controlling section in a display controlling circuit of an LCD device according to the first embodiment of the present invention.
Figure 3:
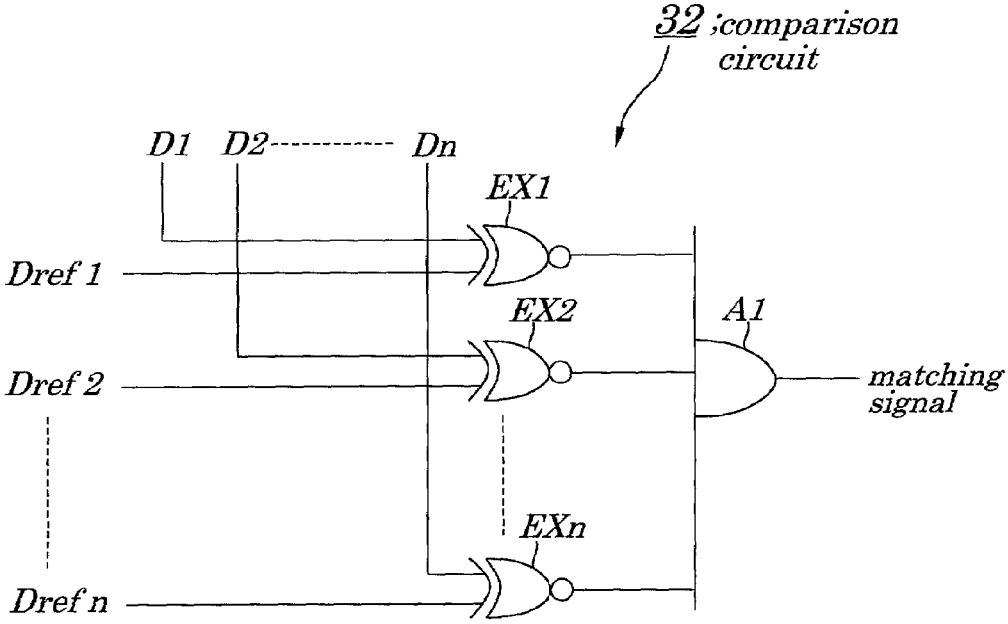
FIG. 3 is a diagram showing configurations of a comparison circuit in the display controlling circuit according to the first embodiment of the present invention.
Figure 4:
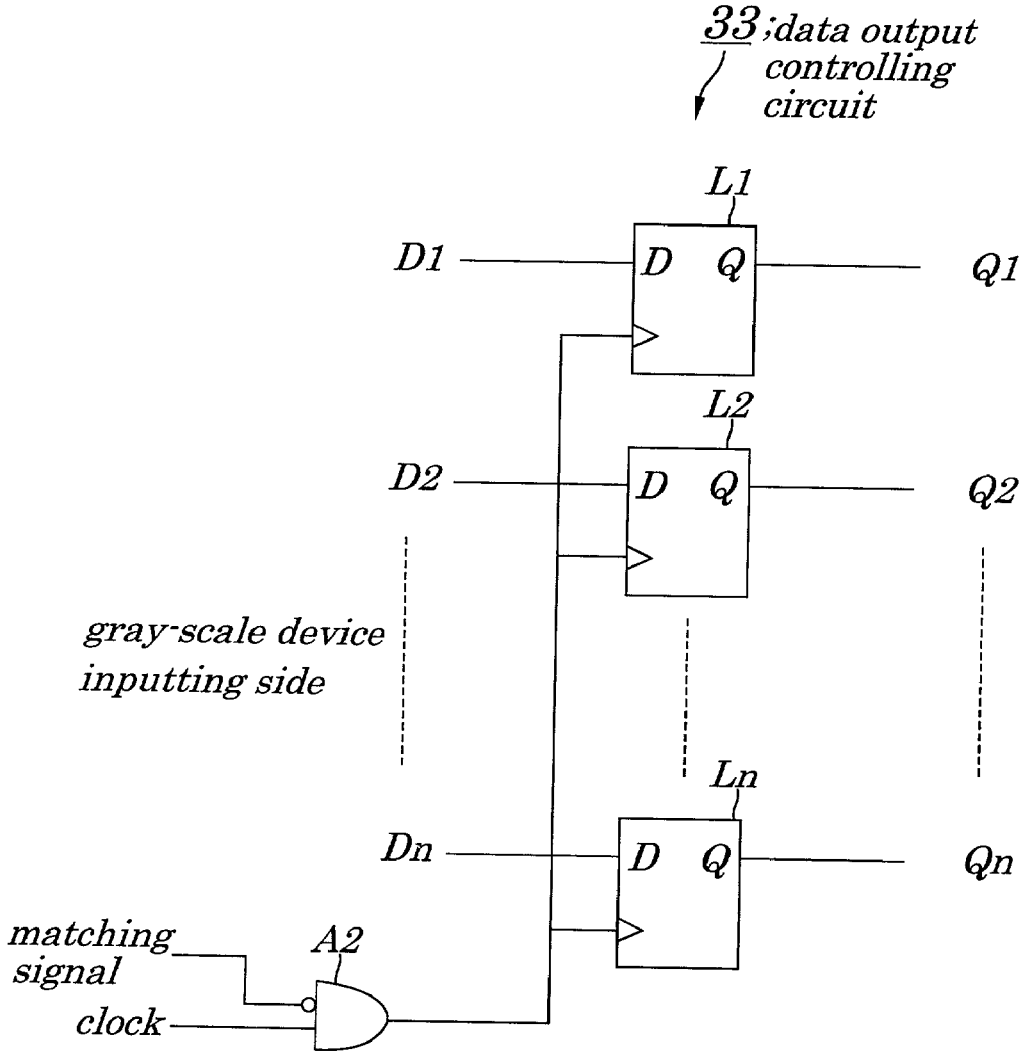
FIG. 4 is a diagram showing configurations of a data output controlling circuit in the display controlling circuit according to the first embodiment of the present invention.
Figure 5:
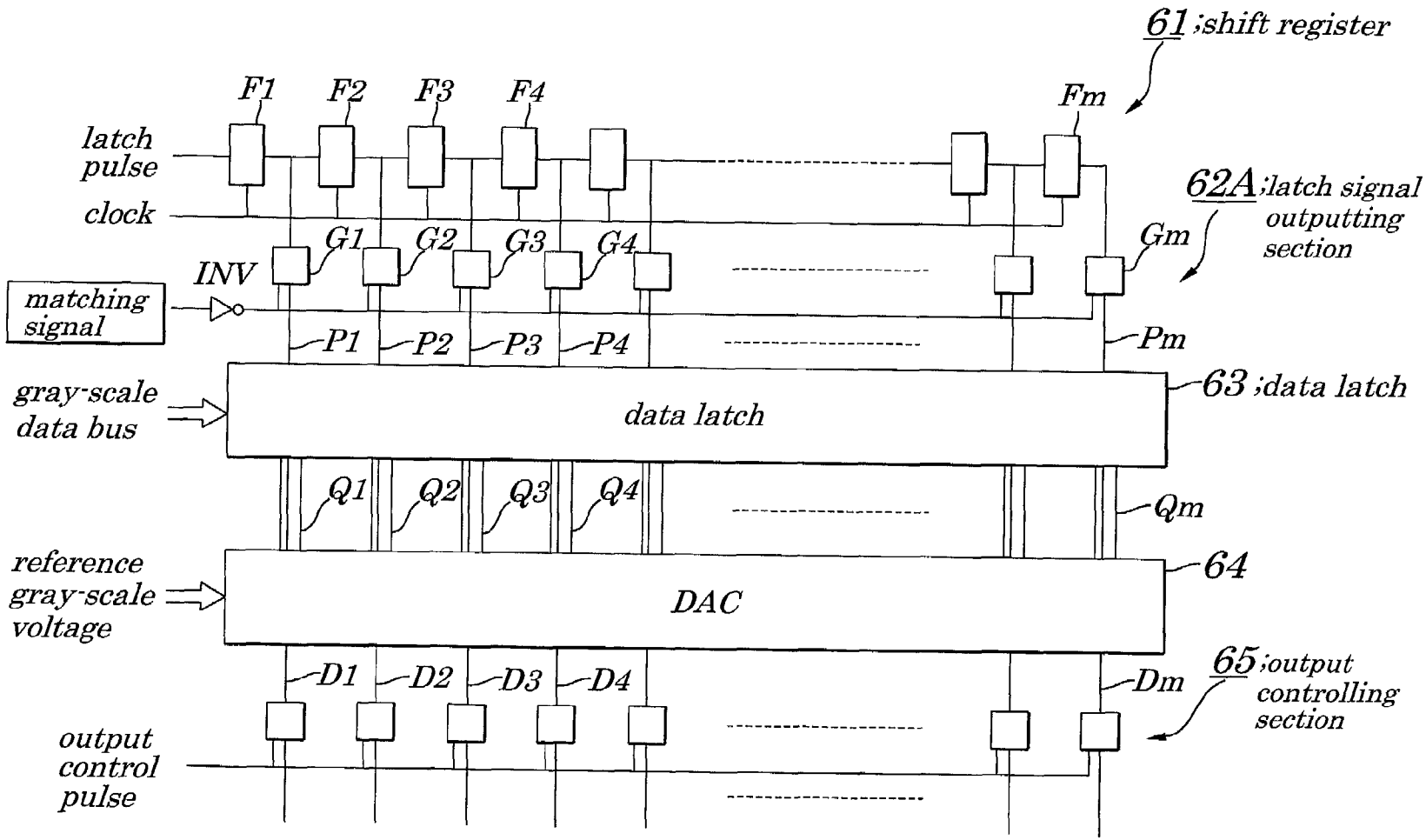
FIG. 5 is a diagram showing configurations of a signal line driving circuit in the LCD device according to the first embodiment of the present invention.
Figure 6:
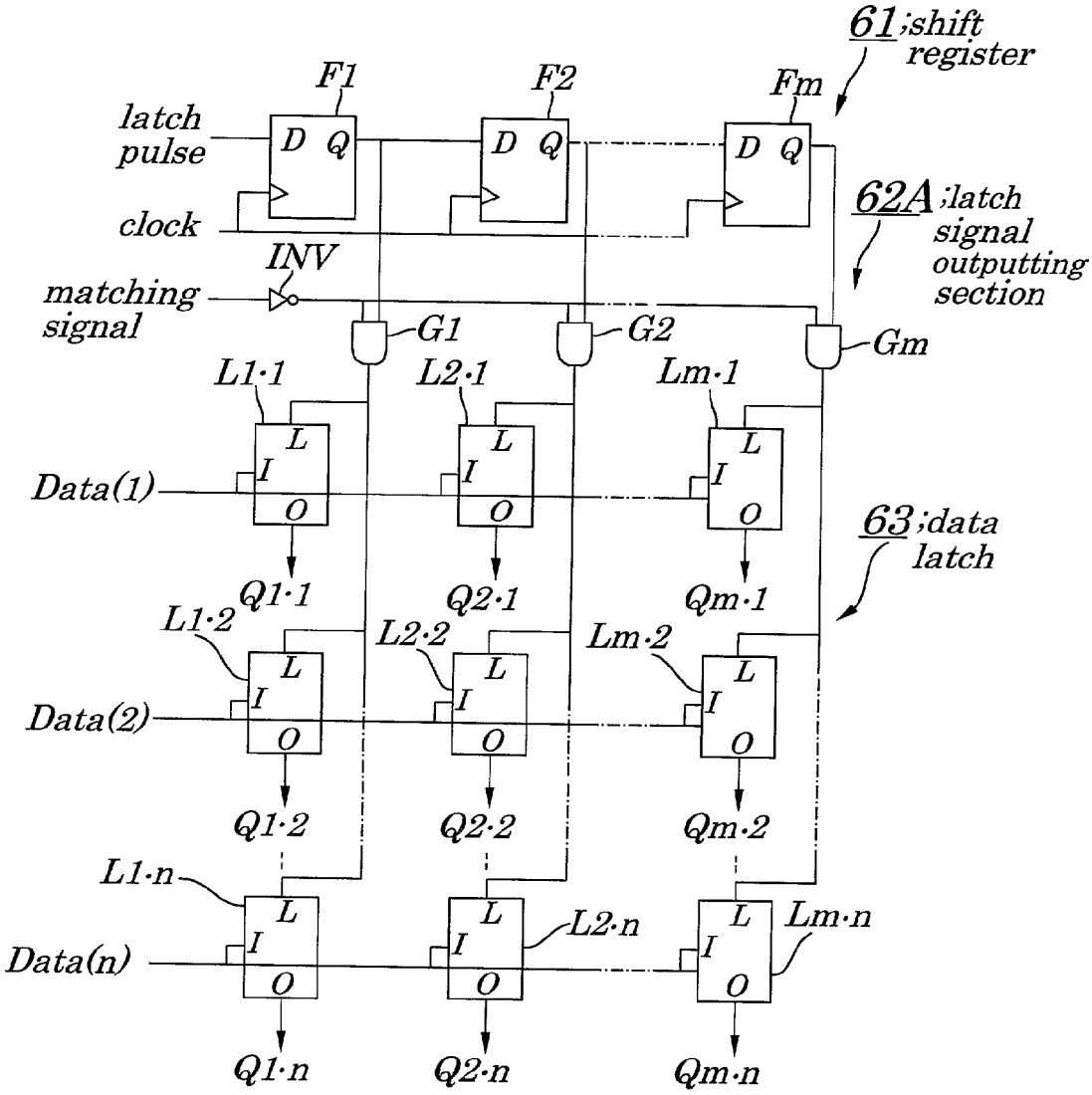
FIG. 6 is a diagram showing a concrete configuration of the signal line driving circuit according to the first embodiment of the present invention.
Figure 7:
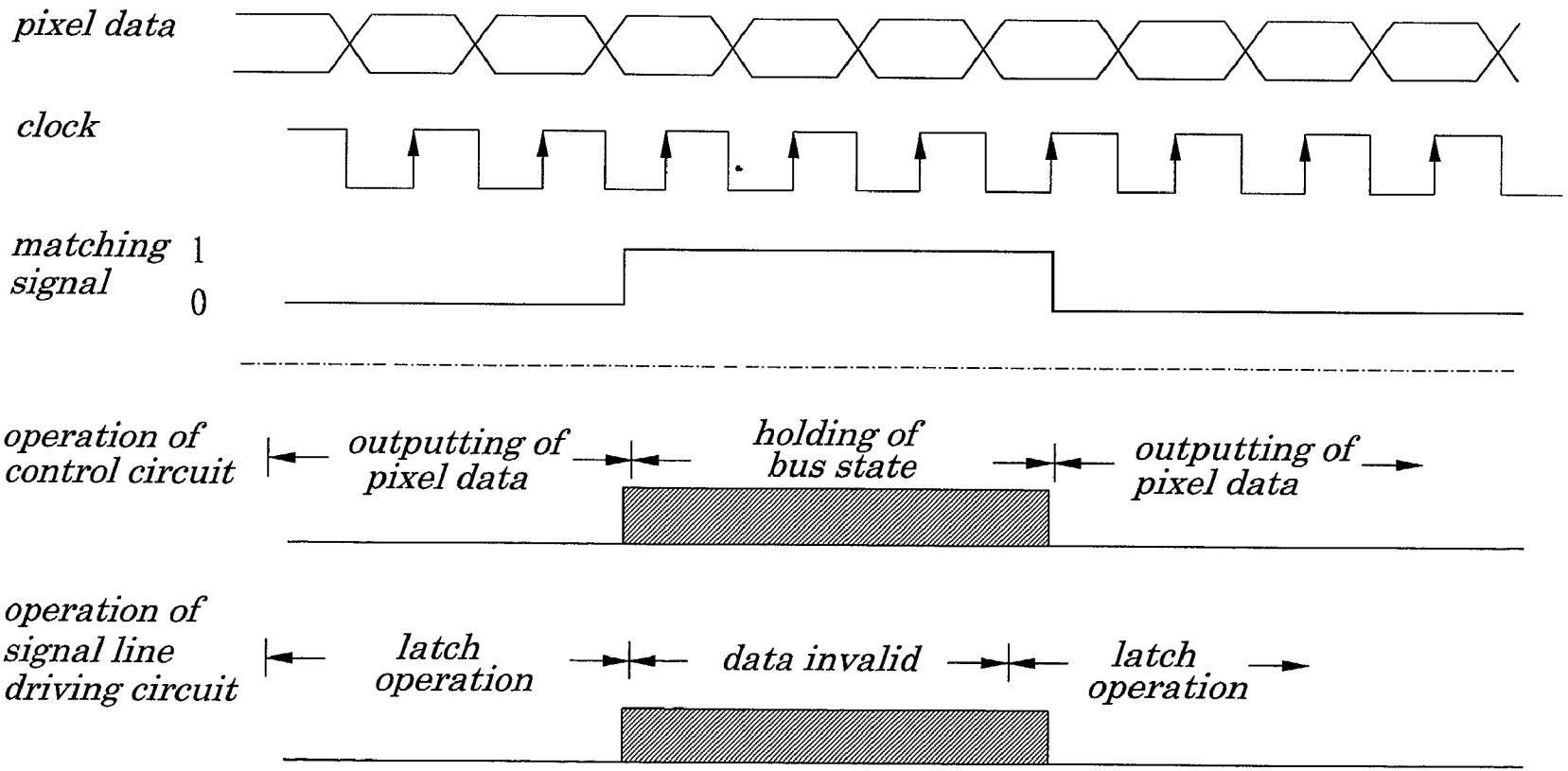
FIG. 7 is a timing chart illustrating operations of the display controlling circuit and the signal line driving circuit of the LCD device according to the first embodiment of the present invention.
Figure 8:
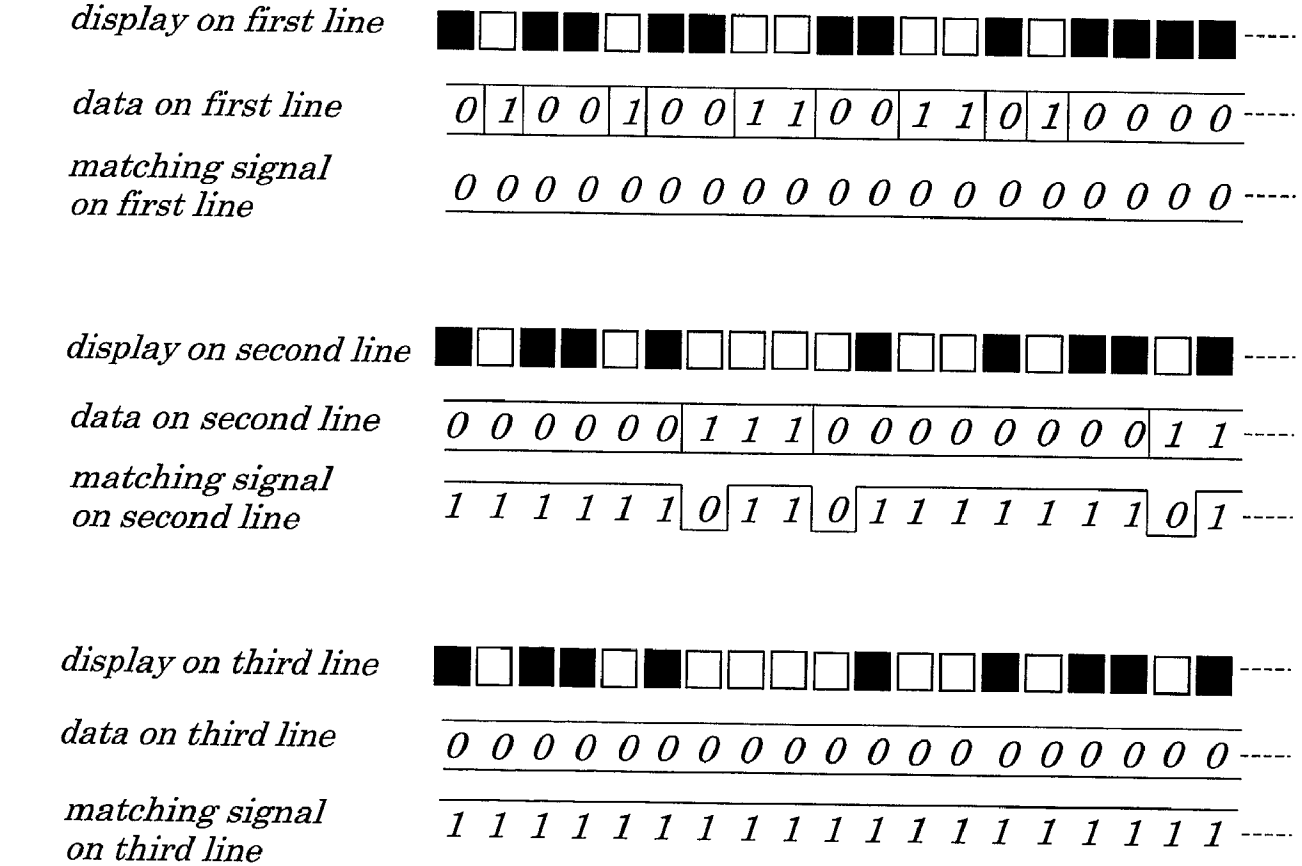
FIG. 8 is a diagram conceptually explaining transfer of gray-scale data in the LCD device according to the first embodiment of the present invention.

FIG. 1 is a diagram showing configurations of an image display device of a first embodiment of the present invention. FIG. 2 is a diagram showing configurations of a gray-scale data comparison controlling section 30 in a display controlling circuit 3A of an LCD device 1A of the first embodiment of the present invention. FIG. 3 is a diagram showing configurations of a comparison circuit 32 in the display controlling circuit 3A of the first embodiment of the present invention. FIG. 4 is a diagram showing configurations of a data output controlling circuit 33 in the display controlling circuit 3A of the first embodiment of the present invention. FIG. 5 is a diagram showing configurations of a signal line driving circuit 6A in the LCD device 1A of the first embodiment of the present invention. FIG. 6 is a diagram showing concrete configurations of the signal line driving circuit 6A of the first embodiment of the present invention. FIG. 7 is a timing chart illustrating operations of the display controlling circuit 3A and the signal line driving circuit 6A of the LCD device 1A of the first embodiment of the present invention. FIG. 8 is a diagram conceptually explaining a transfer of gray-scale data in the LCD device 1A of the first embodiment of the present invention.

Figure 11:
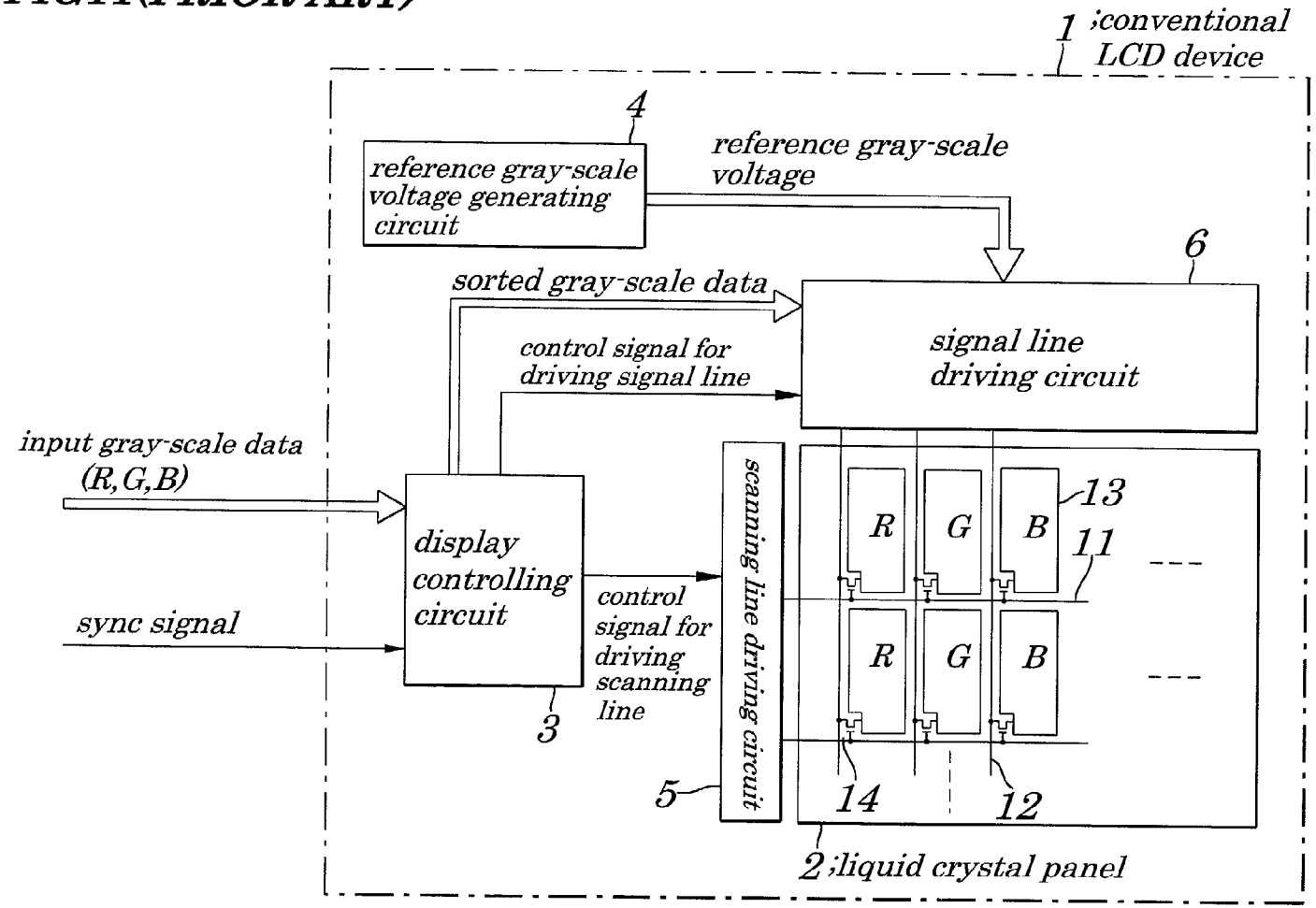
FIG11(PRIOR ART)
FIG. 11 is a schematic block diagram showing an example of configurations of a conventional LCD.

The LCD device 1A, as shown in FIG. 1, chiefly includes a liquid crystal panel 2, the display controlling circuit 3A, a reference gray-scale voltage generating circuit 4, a scanning line driving circuit 5, and the signal line driving circuit 6A. Configurations and operations of the liquid crystal panel 2, the reference gray-scale voltage generating circuit 4, and the scanning line driving circuit 5 are same as those in the case of a conventional case shown in FIG. 11 and their descriptions are omitted. The display controlling circuit 3A, in accordance with a sync (synchronization) signal, sorts input gray-scale data for each of R, G, and B colors for every scanning line so as to correspond to an arrangement of pixels in the liquid crystal panel 2 and produces sorted gray-scale data and outputs them to the signal line driving circuit 6A, and in accordance with a sync signal, outputs a control signal for driving a scanning line to the scanning line driving circuit 5 and outputs a control signal for driving a signal line to the signal line driving circuit 6A. The display controlling circuit 3A has the gray-scale data comparison controlling section 30 adapted to sequentially compare presently sorted gray-scale data in a gray-scale data bus with gray-scale data having been sorted one scanning period before in the gray-scale data bus and to output a matching signal which becomes "1" when the presently sorted gray-scale data in the gray-scale data bus matches with the gray-scale data having been sorted one scanning period before in the gray-scale data bus and becomes "0" when the former does not match with the latter and then exerts control so as to output the sorted gray-scale data to be fed to the signal line driving circuit 6A to the gray-scale data bus or to stop outputting of the above data according to the matching signal "0" or "1".

The signal line driving circuit 6A produces a signal to which a gamma correction is made (that is, a gamma-corrected signal) so as to be corresponded to a V-T characteristic of the liquid crystal panel 2 and according to the sorted gray-scale data fed from the display controlling circuit 3A and to a reference gray-scale voltage fed from the reference gray-scale voltage generating circuit 4 and according to a control signal for driving a signal line for every one scanning period and outputs the gamma-corrected signal for every signal line. At this point, during a section where the input matching signal is "1", the signal line driving circuit 6A holds the gray-scale data produced during a previous scanning period and produces a signal corresponding to the data and then outputs it.

The gray-scale data comparison controlling section 30 in a display controlling circuit 3A of the first embodiment, as shown in FIG. 2, includes a line memory 31, the comparison circuit 32, and the data output controlling circuit 33. The line memory 31 includes shift registers being made up of a number of lines corresponding to a bus width of a gray-scale data bus of n-bits and having a number of steps corresponding to one scanning line, that is, to a number (m) of pixel electrodes mounted in a horizontal direction in the liquid crystal panel 2 and sequentially accumulates gray-scale data bus input in response to a clock. The comparison circuit 32 compares present data in a gray-scale data bus with data provided one scanning period before in the gray-scale data bus fed from the line memory 31 and outputs a matching signal which becomes "1" when the former matches with the latter and which becomes "0" when the former does not match with the latter. The data output controlling circuit 33 allows a signal of a gray-scale data bus to pass through itself when the matching signal is "0" and stops outputting the signal of the gray-scale data bus when the matching signal is "1".

The comparison circuit 32 in the gray-scale data comparison controlling section 30 of the first embodiment, as shown in FIG. 3, includes n-pieces of exclusive NOR circuits EX1, EX2, . . . , EXn and an AND circuit A1 corresponding to a number of bits of gray-scale data. Each of the exclusive NOR circuits EX1, EX2, . . . , EXn compares n-bits of data D1, D2, . . . , Dn in the gray-scale data bus with n-bits of output data Dref 1, Dref 2, . . . , Dref n of the line memory 31 and outputs "1" when the former matches the latter. The AND circuit A1 outputs "1" as a matching signal when outputs of all exclusive NOR circuits EX1, EX2, . . . , Exn are "1" and outputs "0" in other cases.

The data output controlling circuit 33 in the gray-scale data comparison controlling section 30 of the first embodiment, as shown in FIG. 4, includes an AND circuit A2 and D-type flip-flops L1, L2, . . . , and Ln. The AND circuit A2, when the matching signal is "0", makes active each of the D-type flip-flops L1, L2, . . . , and Ln, in accordance with a clock. This causes each of the D-type flip-flops L1, L2, . . . , and Ln to latch data D1, D2, . . . , and Dn in the gray-scale data bus on an input side and to produce renewed output data Q1, Q2, . . . , and Qn.

Figure 12:
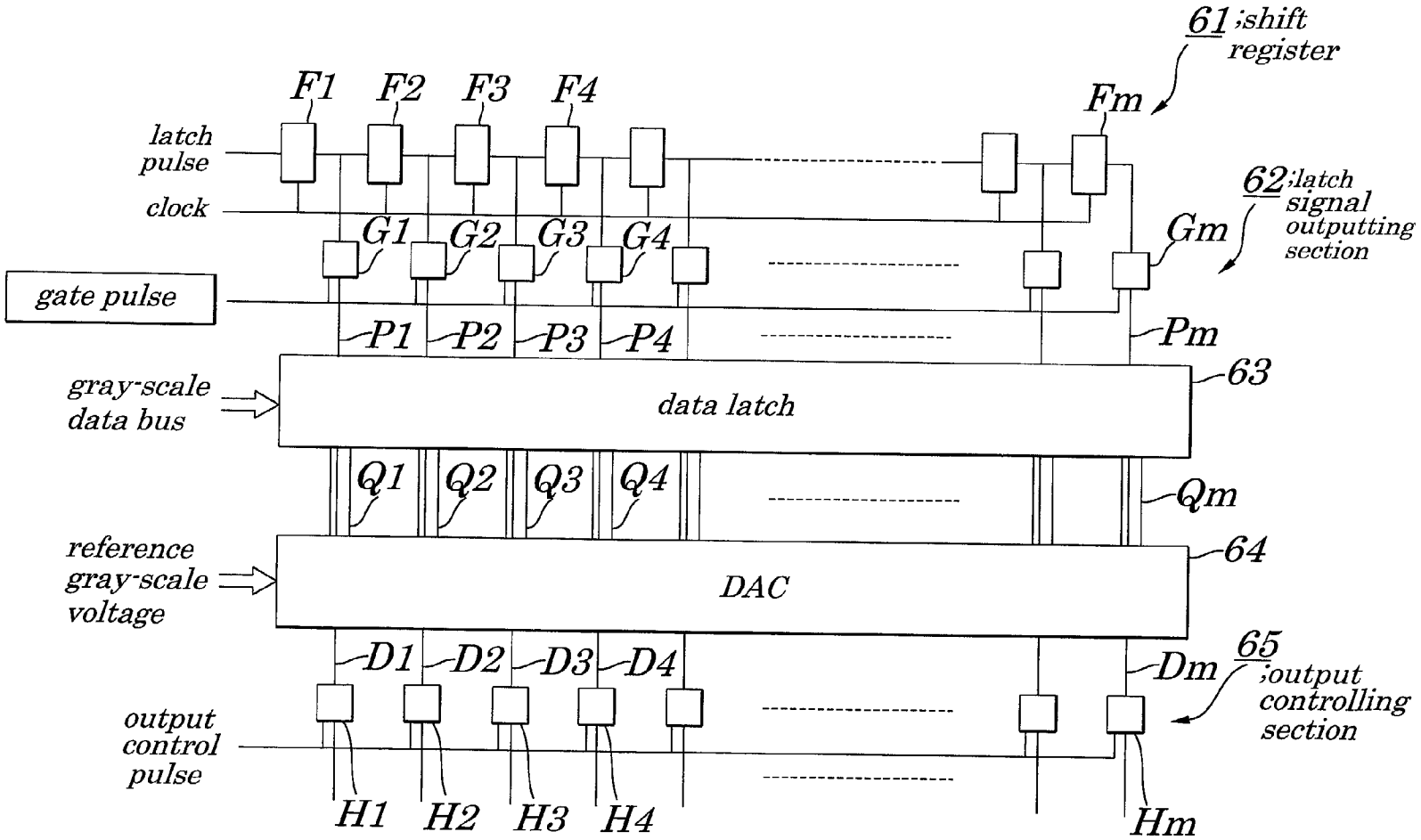
FIG12(PRIOR ART)
FIG. 12 is a schematic block diagram showing an example of configurations of a conventional signal line driving circuit.

The signal line driving circuit 6A in the LCD device 1A of the first embodiment, as shown in FIG. 5, includes a shift register 61, a latch signal outputting section 62A, a data latch 63, a DAC (Digital Analog Converter) 64, and an output controlling section 65. Of them, configurations and operations of the shift register 61, data latch 63, DAC 64, and output controlling section 65 are same as those of the conventional signal line driving circuit 6 shown in FIG. 12 and therefore their detailed descriptions are omitted. The latch signal outputting section 62A, as shown in FIG. 5, includes an inverter INV, gate circuits G1, G2, C3, G4, . . . , and Gm and transfers an output from each of flip-flops F1, F2, F3, F4, . . . , and Fm in the shift register 61 to the data latch 63 in response to a signal obtained by inverting a matching signal input from the display controlling circuit 3A through the inverter INV and, by controlling ON and OFF of the gate circuits G1, G2, G3, G4, . . . , and Gm only in a section when the matching signal becomes "0" and interrupts the output from each of the flip-flops F1, F2, F3, F4, . . . , and Fm when a matching signal is "1" and does not transfer the output to the data latch 63.

FIG. 6 shows an example of concrete configurations of a signal line driving circuit 6A in the LCD device 1A of the first embodiment, in which "m" pieces of signal lines are driven corresponding to "m" pieces of pixel electrodes 13 being made up of R, G, and B pixel electrodes sequentially arranged in a repeated manner in this order in a horizontal direction of the liquid crystal panel 2. In FIG. 6, examples of configurations of the shift register 61, the latch signal outputting section 62A, and the data latch 63 making up such the signal line driving circuit 6A are provided. As shown in Fig 6, the shift register 61 includes D-type flip flops F1, F2, . . . , and Fm and the inverter INV, and the latch signal outputting section 62A is made up of gate circuits G1, G2, . . . , and Gm, and the data latch 63 is made up of L1•1, L1•2, . . . , L1•n, L2 1, L2 2, . . . , L2•n, Lm•1, Lm•2, . . . , Lm•n each being corresponded respectively to Data (1), Data (2), . . . , and Data (n) being stored in the gray-scale data buses of n-bits.

Each of the D-type flip flops F1, F2, . . . , and Fm latches a latch pulse in response to a clock and sequentially transfers it. The latch pulse is a signal used to instruct a signal outputting section corresponding to each of the signal lines to start operations in the signal line driving circuit 6A, which is contained in a signal line controlling signal. Each of the gate circuits G1, G2, . . . , and Gm, when the matching signal is "0", outputs a "Q" output from each of the D-type flip flops F1, F2, . . . , Fm as a latch signal to the data latch 63, in accordance with a reversed signal of a matching signal coming through the inverter INV. Each of the latch circuits L1•1, L1•2, . . . , L1•n, L2 1, L2•2, . . . , L2 n, Lm•1, Lm•2, . . . , and Lm•n, when a latch signal output from the gate circuits G1, G2, . . . , and Gm is "1", latches data "Data (1)", "Data (2)", . . . , "Data (n)" and outputs Q1•1, Q1•2, . . . , Q1•n as gray-scale data Q1 and Q2•1, Q2•2, . . . , Q2•n as gray-scale data Q2 and, thereafter in the similar ways, up to Qm•1, Qm•2, . . . , Qm•n as gray-scale data Qm.

Operations of the LCD device 1A of the first embodiment will be described by referring to FIG. 1 to FIG. 6. The matching signal produced by the display controlling circuit 3A becomes "1" when current gray-scale data matches gray-scale data provided one scanning period before and becomes "0" when the former does not match the latter and is input in response to a latch pulse for every clock. The display controlling circuit 3A outputs sorted gray-scale data in the gray-scale data bus, as it is, at a position of a signal line when the matching signal becomes "0".

Moreover, in the signal line driving circuit 6A, since a corresponding gate circuit in the latch signal outputting section 62A is turned ON at a position of a signal line where the matching signal becomes "0", the data latch 63 latches input and sorted gray-scale data and the DAC 64 produces a DC voltage according to latched input gray-scale data and outputs the produced DC Voltage to a corresponding signal line.

On the other hand, the display controlling circuit 3A holds a state of a bus in the gray-scale data bus at a position of a signal line where the matching signal becomes "1". Moreover, in the signal line driving circuit 6A, since a corresponding gate circuit of the latch signal outputting section 62A is turned OFF at a position of a signal line where the matching signal becomes "1", the data latch 63 does not latch newly sorted gray-scale data and holds gray-scale data provided at a time of previous scanning and the DAC 64 produces a DC voltage according to gray-scale data provided one scanning period before and outputs the produced DC voltage to a corresponding signal line. Moreover, in order to hold the gray-scale data at the time of previous scanning, the data latch 63 can be configured in such a manner that a corresponding latch device does not latch input data when the matching signal is "1" or that the corresponding latch device again latches previous data.

Figure 13:
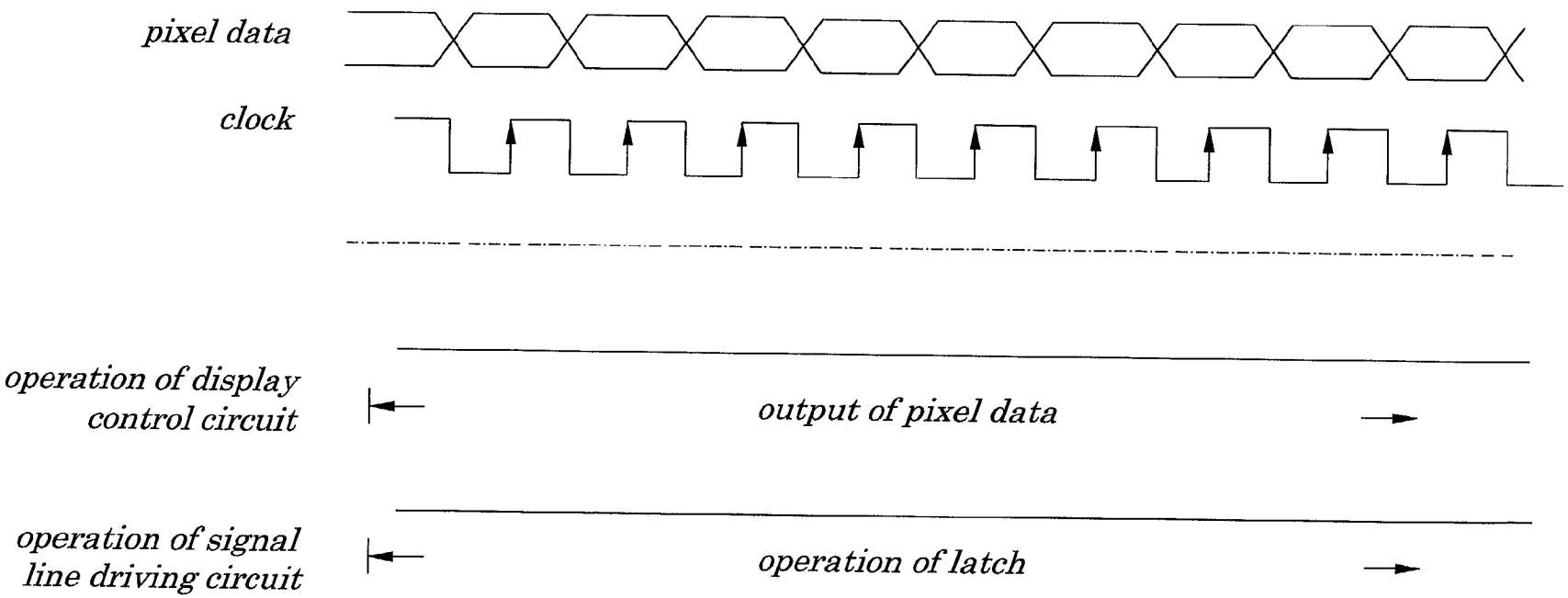
FIG13(PRIOR ART)
FIG. 13 is a timing chart illustrating operations of a display control circuit and a signal line driving circuit in the conventional LCD device.

FIG. 7 is a timing chart illustrating operations of the display controlling circuit 3A and signal line driving circuit 6A of the LCD device 1A according to the first embodiment of the present invention. In the LCD device 1A of the first embodiment, operations of the display controlling circuit 3A and the signal line driving circuit 6A performed when the matching signal is "0" are same as those in the conventional example shown in FIG. 13, that is, the display controlling circuit 3A outputs sorted gray-scale data while the signal line driving circuit 6A performs a latching operation and produces a DC voltage corresponding to a current input of sorted gray-scale data and outputs the produced DC voltage to the signal line.

On the other hand, when the matching signal is "1", the display controlling circuit 3A holds a state of the bus and outputs gray-scale data while the signal line driving circuit 6A makes input data invalid and outputs a DC voltage, which is held in the data latch 63, produced by using gray-scale data provided at a time of previous scanning to a signal line.

Figure 14:
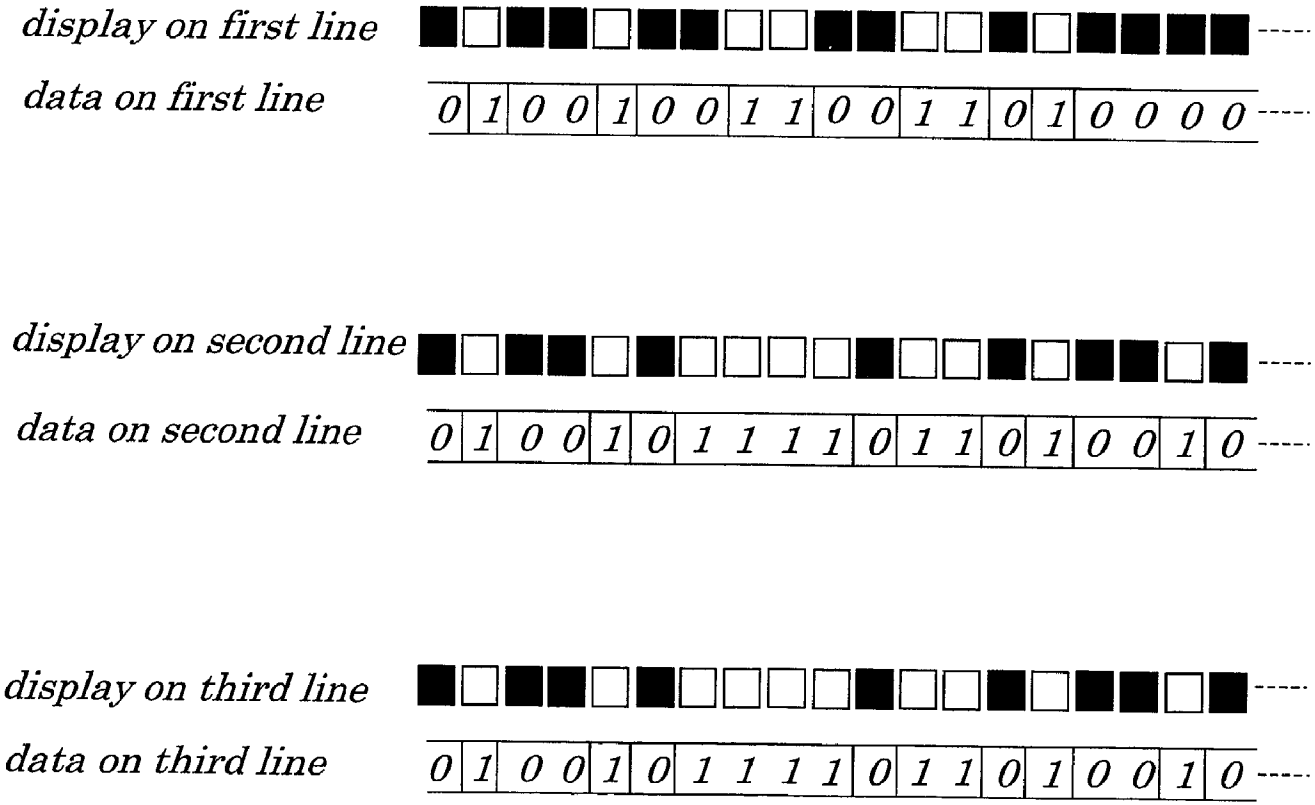
FIG14(PRIOR ART)
FIG. 14 is a diagram conceptually explaining transfer of gray-scale data in the conventional LCD device.

FIG. 8 is a diagram conceptually explaining a transfer of gray-scale data in the LCD device 1A according to the first embodiment of the present invention. Expressions of the image display data and the gray-scale data are same as those shown in FIG. 14. As shown in FIG. 8, in the case of the display image on a first line, since there is no display image to be compared with, a signal "0" is output as a matching signal for all the gray-scale data on the first line. Next, in the case of a second line, in a section where changes occurs in display images when display images on the second line are compared with that on the first line, since a signal "0" is output as a matching signal, gray-scale data in the data latch 63 in this section is renewed. Moreover, in the case of a third line, since display images on the second line and display images on the third line are matched with each other, a signal "1" is output as the matching signal for all the gray-scale data, all the gray-scale data in the data latch are not renewed.

Thus, in the LCD device 1A of the first embodiment, by comparing gray-scale data corresponding to a present line with gray-scale data corresponding to a previous line and, in a section where they are matched with each other, by outputting a matching signal, the signal line driving circuit 6A produces an image signal by using gray-scale data on a previous line and, only in a section where a matching signal is not output, an image signal is produced by gray-scale data on the present line and therefore an amount of gray-scale data to be transferred (number of amplitude of gray-scale data) can be substantially reduced. As a result, a decrease in a feedthrough current in a buffer in a logic section making up the LCD device 1A reduces power consumption in the LCD device 1A and a slowdown in a change of a voltage and current amplitude of gray-scale data in a bus wiring on the liquid crystal panel 2 enables reduction of EMI (Electromagnetic interference).

In the LCD device 1A of the first embodiment, the gray-scale data output from the display controlling circuit 3A is obtained by sorting gray-scale data for each of the R, G, and B colors according to an arrangement of a pixel electrode 13 of the liquid crystal panel 2 which is transferred to the signal line driving circuit 6A by the gray-scale data bus being for example 6 bits wide. The signal line driving circuit 6A sequentially latches the above gray-scale data in every signal line and converts it to a DC voltage and then outputs it to a signal line. However, the LCD device 1A of the first embodiment may be so configured that the display controlling circuit 3A transfers gray-scale data for each of the R, G, and B colors, in parallel and without sorting them, to the signal line driving circuit 6A which then collectively latches one set of gray-scale data for the R, G, and B colors and converts the latched gray-scale data to a DC voltage and then outputs all at once to one set (1 port) of signal lines for the R, G, and B colors. As such the signal line driving method, 18-bit 1 port method and 24-bit 1 port method in which an output is produced by one set of gray-scale data for the R, G, and B colors each being made up of, for example, 6 bits or 8 bits to one set of signal lines for the R, G, and B colors and 36-bit 2 port method and 48-bit 2 port method in which an output is produced by two sets of gray-scale data for the R, G, and B colors each being made up of 6 bits and 8 bits to two sets of signal lines for the R, G, and B are already known.

In the LCD device 1A of the first embodiment, when being employed by the LCD device 1A of such the gray-scale data parallel transmission method, though a width of a gray-scale data bus becomes large, since a transfer speed of the gray-scale data for each of the R, G, and B colors is reduced, it is possible to reduce EMI. Another embodiment of the present invention is explained in which the gray-scale data parallel method is applied.

Second Embodiment

Figure 9:
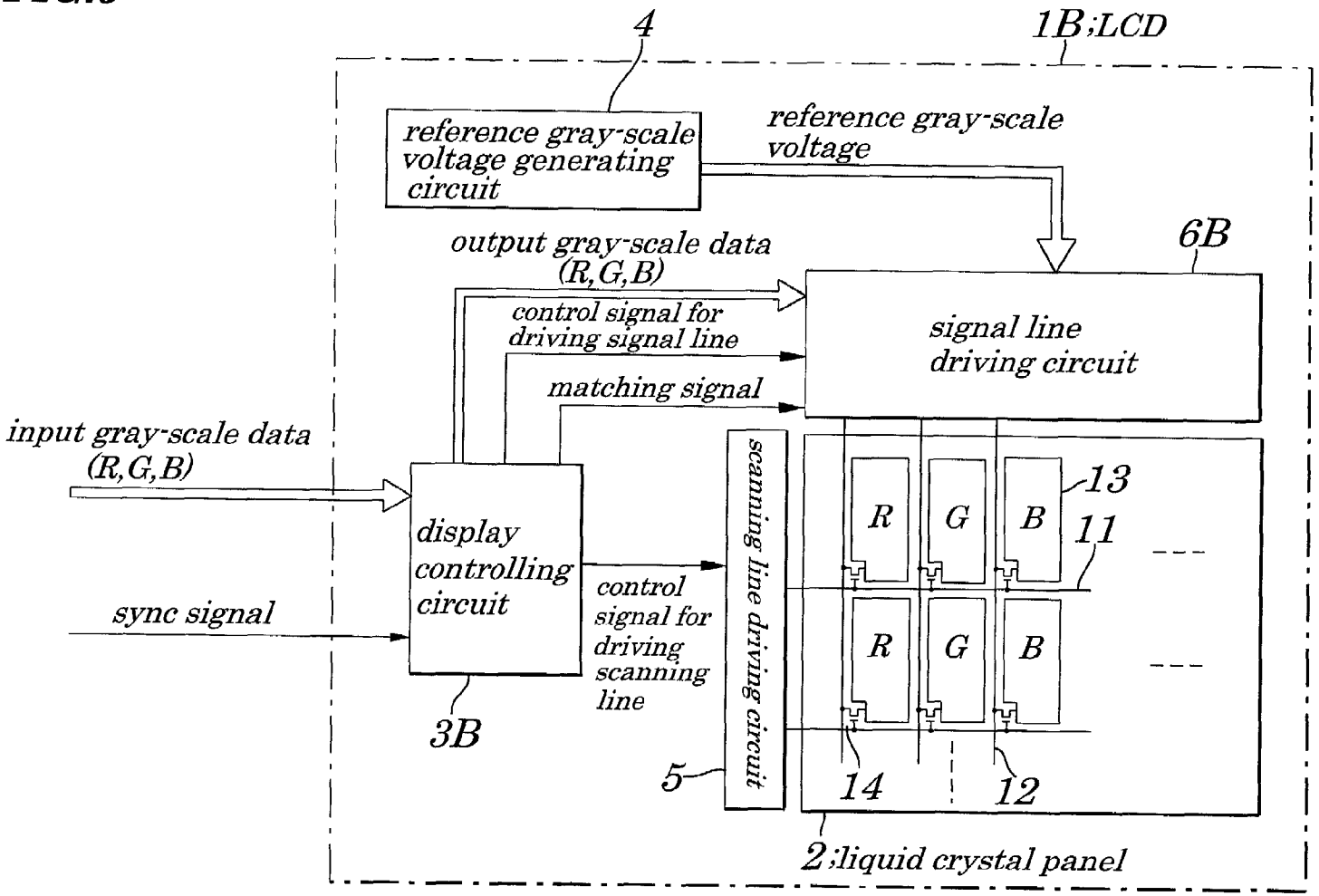
FIG. 9 is a schematic block diagram showing configurations of an LCD device according to a second embodiment of the present invention.
Figure 10:
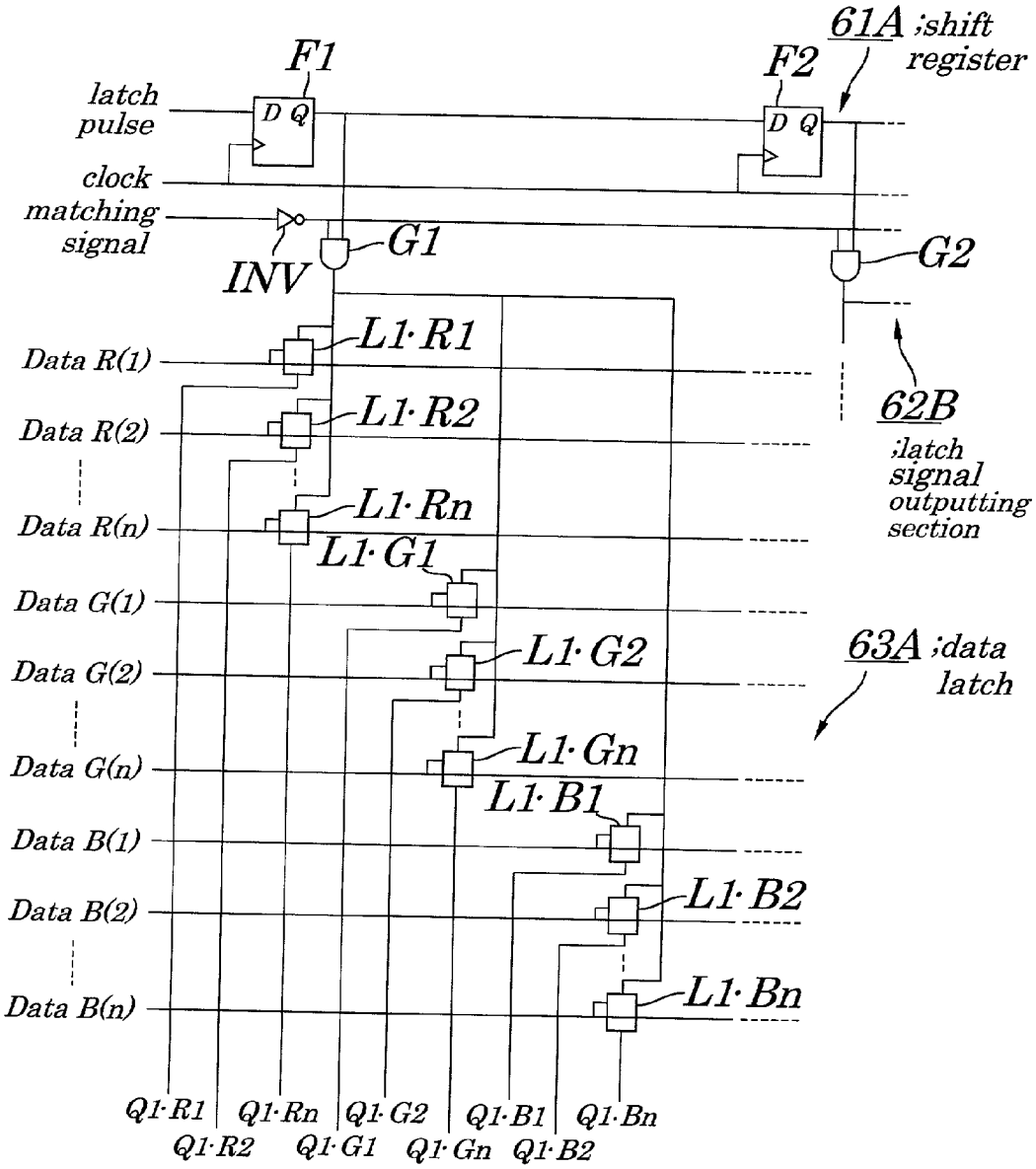
FIG. 10 is a diagram showing concrete configurations of a signal line driving circuit according to the second embodiment of the present invention.

FIG. 9 is a schematic block diagram showing configurations of an LCD device 1B of a second embodiment of the present invention. FIG. 10 is a diagram showing concrete configurations of a signal line driving circuit 6B of the second embodiment. In the second embodiment, an example of a 3n-bit 1 port method is provided in which 1 port of signal lines containing signal lines for R, G, and B colors is driven by gray-scale data of n-bits (for example, n=6, 8, . . . ).

The LCD device 1B of the second embodiment, as shown in FIG. 9, chiefly includes a liquid crystal panel 2, a display controlling circuit 3B, a reference gray-scale voltage generating circuit 4, a scanning line driving circuit 5, and a signal line driving circuit 6B. Configurations and operations of the liquid crystal panel 2, the reference gray-scale voltage generating circuit 4, and the scanning line driving circuit 5 are same as in the case of the conventional example shown in FIG. 1 and their descriptions are omitted hereinafter.

The display controlling circuit 3B exerts control so as to, in parallel, output or stop outputting one set of input gray-scale data for the R, G, and B colors as output gray-scale data to the signal line driving circuit 6B and, in response to a sync signal, outputs a control signal for driving a scanning line to the scanning line driving circuit 5 and a control signal for driving a signal line to the signal line driving circuit 6B. At this point, a period of a latch pulse contained in the control signal for driving the signal line is longer by three times than that in the case of the first embodiment shown in FIG. 6. The display controlling circuit 3B has a gray-scale data comparison controlling section (not shown) adapted to sequentially compare one set of current gray-scale data for the R, G, and B colors in a gray-scale data bus with one set of gray-scale data for the R, G, and B colors provided one scanning period before in the gray-scale data bus and to exert control so as to output, during a period to receive the latch pulse, a matching signal which becomes "1" when the current one set of the gray-scale data in the gray-scale data bus matches with the gray-scale data provided one scanning period before in the gray-scale data bus and becomes "0" when the former does not match with the latter and so as to output, during every section and according to the matching signal "0" or "1", one set of the gray-scale data for the R, G, and B colors through the gray-scale data bus to the signal line driving circuit 6B or to stop outputting the above gray-scale data. The signal line driving circuit 6B produces, every one scanning period according to a control signal for driving a signal line, a signal having undergone a gamma correction so as to be responsive to a V-T characteristic of the liquid crystal panel 2 in accordance with gray-scale data, output in parallel, for the R, G, and B colors fed from the display controlling circuit 3B and with a reference gray-scale voltage fed from the reference gray-scale voltage generating circuit 4 and output the produced signal for every signal line for the R, G, and B colors. At this point, the signal line driving circuit 6B, during a section in which the matching signal is "0", holds one set of the input gray-scale data for the R, G, and B colors and produces and outputs a signal voltage based on the gray-scale data and, during a section in which the matching signal is "1", produces and outputs a signal voltage based on the input gray-scale data for one set of the R, G, and B colors having been held during the previous scanning period.

FIG. 10 is a diagram showing concrete configurations of the signal line driving circuit 6B according to the second embodiment and shows an example of a case of the 3n-bit 1 port method. In FIG. 10, in the signal line driving circuit 6B, configurations of a shift register 61A, a latch signal outputting section 62B, and a data latch 63A are shown as an example. Moreover, as shown in FIG. 10, D-type flip-flops F1, F2, . . . , and Fn making up the shift register 61A at an "a" (a=m/3) stage are mounted. Also, an inverter INV is provided. The "a" (a=m/3) pieces of gate circuits G1, G2, . . . , and Gn making up the latch signal outputting section 62B are mounted. Latch circuits L1•R1, L1•R2, . . . , L1•Rn, L1•G1, L1•G2, . . . , L1•Gn, L1•B1, L1•B2 . . . , and L1•Bn correspond to signal lines for each of the R, G, and B colors making up a first set of the signal line and to data Data R (1), Data R (2), . . . , Data R (n), Data G (1), Data G (2), . . . , Data G (n), Data B (1), Data B (2), . . . , Data B (n) in the gray-scale data bus for each of the R, G, and B colors each being made up of "n" bits out of latch circuits making up the data latch 63A. Moreover, in FIG. 10, drawings of latch circuits corresponding to gray-scale data for each of the R, G, and B colors making up other (a−1) sets in the data latch 63A are omitted.

The D-type flip-flops F1, F2, . . . , and Fn, during a horizontal scanning period and according to a clock, latches a latch pulse being output once for three signal lines for the R, G, and B colors and sequentially transfers it. The gate circuits G1, G2, . . . , and Gn, in accordance with a reversed signal of a matching signal fed through the inverter INV and, when the matching signal is "0", outputs a "Q" output from each of the D-type flip-flops F1, F2, and Fn, to the data latch 63A as a latch signal.

The latch circuits L1•R1, L1•R2, . . . , L1•Rn, L1•G1, L1•G2, . . . , L1•Gn, L1•B1, L1•B2 . . . , and L1•Bn, when a latch signal output from the gate circuit G1 is "1", latch data Data R (1), Data R (2), . . . , Data R (n), Data G (1), Data G (2), . . . , Data G (n), Data B (1), Data B (2), . . . , and Data B (n) in the gray-scale data bus and output gray-scale data Q1•R1, Q1•R2, . . . , Q1•Rn, Q1•G1, Q1•G2, . . . , Q1•Gn, Q1•B1, Q1•B2 . . . , and Q1•Bn to the DAC 64.

The DAC 64, in accordance with the gray-scale data Q1•R1, Q1•R2, . . . , Q1•Rn, Q1•G1, Q1•G2, . . . , Q1•Gn, Q1•B1, Q1•B2 . . . , and Q1•Bn and with a reference gray-scale voltage from the reference gray-scale voltage generating circuit 4, produces a signal voltage to be supplied to signal lines for each of the R, G, and B colors making up the first set of the signal line and feeds it to the liquid crystal panel 2. A signal voltage to be supplied to signal lines for the R, G, and B colors making up other set of the signal line is produced in the same manner.

The LCD 1B of the second embodiment is so configured that, by comparing gray-scale data corresponding to a present line with gray-scale data corresponding to a previous line and by outputting a matching signal during a section in which both of them are matched with each other, an image signal is produced in the signal line driving circuit 6B using gray-scale data on the present line and that an image signal is produced using gray-scale data on the present line only during a section in which a matching signal is not outputted and, as a result, an amount of transfer of gray-scale data is substantially reduced and, moreover, an output signal is produced together by "n" bits of gray-scale data in the signal line driving circuit 6B for every 1 port for the R, G, and B colors and a speed of transfer of gray-scale data in a bus wiring of the liquid crystal panel 2 is reduced, thus enabling more reduction of power consumption and EMI when compared with the case of the first embodiment.

The LCD 1B of the second embodiment described above can be also applied in a case where its driving is carried out by gray-scale data of "n" bits for every arbitrary "i" ("i" is a natural number being 2 or more) ports of signal lines for the R, G, and B colors. In this case, the display controlling circuit 3B sequentially outputs gray-scale data for each of the R, G, and B colors being made up of serial data or stops outputting the gray-scale data, by "i" sets and in parallel, to the signal line driving circuit 6B through the gray-scale data bus and, in response to a sync signal, outputs a control signal for driving a scanning line to the scanning line driving circuit 5 and a control signal for driving a signal line to the signal line driving circuit 6B. At this point, a period of a latch pulse contained in the control signal for driving the signal line is longer by "3i" times than that in the first embodiment shown in FIG. 6. The gray-scale data comparison control section (not shown) sequentially compares present "i" sets of input gray-scale data for the R, G, and B colors in the input gray-scale data bus with "i" sets of gray-scale data for the R, G, and B colors provided one scanning period before in the input gray-scale data bus and exerts control so as to output a matching signal which, during a latch pulse period, becomes "1" when both of them are matched with each other and becomes "0" when both of them does not match with each other, depending on whether the matching signal becomes "0" or "1", "i" sets of gray-scale data for the R, G, and B colors or so as to stop outputting the gray-scale data through the gray-scale data bus to the signal line driving circuit 6B.

Moreover, the signal line driving circuit 6B, during a section where a matching signal is "0", produces "i" sets of parallel gray-scale data for the R, G, and B colors fed from the display controlling circuit 3B in response to a latch pulse indicating a latch pulse of "i" sets of signal lines for the R, G, and B colors and a signal voltage having undergone a gamma correction so as to respond to a V-T characteristic of a liquid crystal panel 12 according to a reference gray-scale voltage fed from the reference gray-scale voltage generating circuit 4 and then outputs it for every "i" sets of the signal lines for the R , G, and B colors. On the other hand, the signal line driving circuit 6B, during a section in which a matching signal is "1", according to "i" sets of parallel gray-scale data for the R, G, B colors being held during a previous scanning period and to a reference gray-scale voltage, produces a signal voltage having undergone a gamma correction and outputs it for every "i" sets of signal lines for the R, G, B colors.

Moreover, the signal line driving circuit 6B includes the shift register 61A made up of "m/3i" pieces of D-type flip flops, F1, F2, . . . , Fn, the latch signal outputting section 62 made up of "m/3i" pieces of gate circuits, and m-column data latch having "n" pieces of the latch circuits for every one signal line.

The "3i" sets of the latch circuits latch, when a matching signal is "0" and according to a latch signal output through the gate circuit, "i" sets of gray-scale data for the R, G, and B colors each being made up of "n" bits being sequentially input and output it to the DAC. When the matching signal is "1", a corresponding latch circuit, since a latch signal is not input, outputs "i" sets of data for the R, G, and B colors being made up of "n" bits, which causes the DAC to output a signal voltage for every "i" sets of signal lines for the R, G, and B colors.

It is apparent that the present invention is not limited to the above embodiments but may be changed and modified without departing from the scope and spirit of the invention. For example, the number of bits "n" of gray-scale data for each of the R, G, and B may be set to be arbitrary depending on a number of colors that can be expressed and a number of pixel electrodes mounted in a horizontal direction and a vertical direction making up a display panel is set to be arbitrary. Moreover, the present invention may be applied to a monochrome image display device. In this case, a display control unit is provided to allow pixel data to be output to a display panel in which a plurality of rows of scanning lines and a plurality of columns of signal lines are arranged where pixel electrodes are mounted at every point of intersections of each of the scanning lines and of each of the signal lines, and a scanning line driving unit is provided to allow a scanning line on each row to be sequentially scanned for every scanning period and a signal line driving unit is provided to allow monochrome pixel data to be fed to each column of signal lines in every scanning period. As a means for controlling a display, a pixel data comparison controlling unit is provided which exerts control so as to generate a matching signal showing a result from comparison as to whether input pixel data and pixel data given one scanning period before match or do not match with each other, and to output pixel data from the display controlling unit when the matching signal shows that the above data do not match with each other and to stop outputting the pixel data when the matching signal shows that the above data match with each other. Also, a signal line driving unit is provided which is adapted to latch, when the matching signal shows that the above data match with each other, input pixel data in response to a latch pulse providing timing for driving each of signal lines and to generate and output a signal voltage based on the pixel data latched during a previous scanning period.

What is claimed is:

1. An image display device comprising:

a display panel in which a pixel electrode is arranged at every point of intersections of scanning lines and signal lines;

a display control circuit to sort digital gray-scale data so as to correspond to a pixel arrangement in said display panel and to output the sorted digital gray-scale data;

a scanning line driving circuit to sequentially scan said scanning line on each of rows in every scanning period; and a signal line driving circuit to generate a signal voltage responsive to said sorted gray-scale data for each of the signal lines and to feed a produced signal voltage to a corresponding signal line on each column in every scanning period;

wherein said display control circuit has a gray-scale data comparison controlling circuit which produces a matching signal indicating an exact match or non-match obtained by a result from comparison between a present row of gray-scale data and a previous row of gray-scale data provided one scanning period before and exerts control so as to output said present row of gray-scale data to said line driving circuit when said matching signal indicates the non-match and not to output said present row of gray-scale data but to output said matching signal to said signal line driving circuit when said matching signal indicates the exact match; and wherein said signal line driving circuit is so configured as to latch, when said matching signal indicates the non-match, said present row of gray-scale data in response to a latch pulse providing driving timing of each of said signal lines and as to produce and output a signal voltage based on the latched present row of gray-scale data and, when said matching signal indicates an exact match, to output a signal voltage based on said previous row of gray-scale data latched from one said scanning period before.

2. The image display device according to claim 1, wherein said gray-scale data comparison controlling circuit comprises a line memory to hold said previous row of gray-scale data previously input and to output said previous row of gray-scale data one scanning period later, a comparing circuit to compare said present row of gray-scale data presently input with said previous row of gray-scale data output from said line memory and, when both of them are matched with each other, to output said matching signal indicating the exact match, and a data output controlling circuit to stop or perform outputting of said present row of gray-scale data to said signal line driving circuit depending on whether said matching signal indicates the exact match or the non-match.

3. The image display device according to claim 2, wherein said comparing circuit comprises a plurality of exclusive NOR circuits to detect, for every corresponding bit, whether there is a match between said present row of input gray-scale data and said previous row of gray-scale data output from said line memory and an AND circuit to output said matching signal indicating the exact match or non-match based on an AND of an output from a plurality of said exclusive NOR circuits.

4. The image display device according to claim 2, wherein said data output controlling circuit comprises a plurality of flip flops to latch, when said matching signal indicates the non-match, said input gray-scale data for every bit and to update its output.

5. The image display device according to claim 1, wherein said signal line driving circuit comprises shift registers existing at a plurality of stages each sequentially transferring said latch pulse and outputting it to each of said corresponding signal lines, a latch signal outputting circuit having a plurality of gate circuits mounted responsive to an output from said shift register existing at each stage and outputs, when said matching signal indicates the non-match, signals from said shift register at a corresponding stage as a latch signal, and a data latch to latch a plurality of bits of input gray-scale data for every bit responsive to a latch signal of each of gate circuits and to output it to each of said corresponding signal lines.

6. The image display device according to claim 1, wherein said display panel is a liquid crystal panel.

7. A method for driving an image display device to perform an image display on a display panel in which a pixel electrode is arranged at every point of intersections of scanning lines and signal lines by producing a signal voltage responsive to digital gray-scale data being sorted so as to correspond to a pixel arrangement of said display panel and by sequentially scanning said scanning line on each of rows and by feeding the produced signal voltage to said signal line at each column, said method comprising:

a step of producing a matching signal indicating an exact match or non-match obtained by a result from comparison between input gray-scale data and gray-scale data provided one scanning period before and by exerting control so as to output gray-scale data when said matching signal indicates the non-match and to stop outputting said gray-scale data when said matching signal indicates the exact match; and a step of latching, when said matching signal indicates the non-match, input gray-scale data in response to a latch pulse providing driving timing of each of said signal lines and producing a signal voltage using said gray-scale data unmodified by said gray-scale data from one scanning period before and, when said matching signal indicates the exact match, of producing and outputting a signal voltage based on gray-scale data latched during a previous scanning period.

8. The method for driving an image display device according to claim 7, wherein said display panel is a liquid crystal panel.

9. An image display device comprising:

a display panel in which a pixel electrode is arranged at every point of intersections of scanning lines and signal lines;

a display control circuit to output, sequentially and in parallel, digital gray-scale data for every "i" sets of said digital gray-scale data being input successively;

a scanning line driving circuit to sequentially scan a scanning line on each of rows in every scanning period;

a signal line driving circuit to generate a signal voltage responsive to the parallel gray-scale data and to feed it for every corresponding "i" sets of signal lines;

wherein said display control circuit has a gray-scale data comparison controlling circuit which produces a matching signal indicating an exact match or non-match obtained by a result from comparison between "i" sets of input gray-scale data and "i" sets of gray-scale data provided one scanning period before and exerts control so as to output "i" sets of gray-scale data when said matching signal indicates the non-match and to stop outputting said "i" sets of gray-scale data when said matching signal indicates the exact match; and wherein said signal line driving circuit is so configured as to latch, when said matching signal indicates non-matching, "i" sets of input gray-scale data in response to a latch pulse providing driving timing of said "i" sets of signal lines and so as to produce a signal voltage using said gray-scale data unmodified by said gray-scale data from one scanning period before and, when said matching signal indicates the exact match, to output a signal voltage based on "i" sets of gray-scale data latched during said scanning period.

10. The image display device according to claim 9, wherein said gray-scale data comparison controlling circuit comprises a line memory to hold said input gray-scale data and to output it one scanning period later, a comparing circuit to compare said input gray-scale data with output gray-scale data stored in said line memory and, when both of them are matched with each other, to output said matching signal, and a data output controlling circuit to stop or perform outputting gray-scale data responsive to the match and non-match of said matching signal.

11. The image display device according to claim 10, wherein said comparing circuit comprises a plurality of exclusive NOR circuits to detect, for every corresponding bit, whether there is matching between said input gray-scale data and output gray-scale data stored in said line memory and an AND circuit to output said matching signal based on an AND of an output from a plurality of said exclusive NOR circuits.

12. The image display device according to claim 10, wherein said data output controlling circuit comprises a plurality of flip flops to latch, when said matching signal indicates the non-match, said input gray-scale data for every bit and to update its output.

13. The image display device according to claim 9, wherein said signal line driving circuit comprises shift registers existing at a plurality of stages each sequentially transferring said latch pulse and outputting it to each of a 3i-th signal line, a latch signal outputting circuit having a plurality of gate circuits mounted responsive to an output from said shift register existing at each stage and outputs, when said matching signal indicates the non-match, signals from said shift register at a corresponding stage as a latch signal, and a data latch to latch a plurality of bits of "i" sets of input gray-scale data for R (red), G (red), and B (blue) colors for every bit responsive to a latch signal of each of gate circuits and to output it to each of said corresponding signal lines.

14. The image display device according to claim 9, wherein said display panel is a liquid crystal panel.

15. A method for driving an image display device to perform an image display on a display panel in which a pixel electrode is arranged at every point of intersections of scanning lines and signal lines by generating a signal voltage responsive to "i" sets of digital gray-scale data being input in parallel and consecutively and by sequentially scanning said scanning line on each of rows and by feeding a produced signal voltage to said signal line at each column, said method comprising:

a step of producing a matching signal indicating an exact match or non-match obtained by a result from comparison between "i" sets of input gray-scale data and "i" sets of gray-scale data provided one scanning period before and by exerting control so as to output said "i" sets of gray-scale data when said matching signal indicates the non-match and to stop outputting said gray-scale data when said matching signal indicates the exact match; and a step of latching, when said matching signal indicates the non-match, said "i" sets of input gray-scale data in response to a latch pulse providing driving timing of each of said "i" sets of signal lines, and of producing and outputting "i" sets of signal voltages using said gray-scale data unmodified by said gray-scale data from one scanning period before and, when said matching signal indicates the exact match, of producing and outputting "i" sets of signal voltage based on "i" sets of gray-scale data latched during a previous scanning period.

16. The method for driving an image display device according to claim 15, wherein said display panel is a liquid crystal panel.

17. An image display device comprising:

a display panel in which a pixel electrode is arranged at every point of intersections of scanning lines and signal lines;

a display controller to sort digital gray-scale data so as to correspond to a pixel arrangement in said display panel and to output the sorted digital gray-scale data;

a scanning line driver to sequentially scan said scanning line on each of rows in every scanning period; and a signal line driver to generate a signal voltage responsive to said sorted gray-scale data for each of the signal lines and to feed a produced signal voltage to a corresponding signal line on each column in every scanning period;

wherein said display controller has a gray-scale data comparison controller which produces a matching signal indicating an exact match or non-match obtained by a result from comparison between input gray-scale data and gray-scale data provided one scanning period before and exerts control so as to output gray-scale data when said matching signal indicates the non-match and to stop outputting said gray-scale data when said matching signal indicates the exact match; and wherein said signal line driver is so configured as to latch, when said matching signal indicates the non-match, input gray-scale data in response to a latch pulse providing driving timing of each of said signal lines and as to produce and output a signal voltage using said gray-scale data unmodified by said gray-scale data from one scanning period before and, when said matching signal indicates an exact match, as to output a signal voltage based on gray-scale data latched during said scanning period.

18. The image display device according to claim 17, wherein said gray-scale data comparison controller comprises a line memory to hold input gray-scale data and to output it one scanning period later, a comparator to compare input gray-scale data with output gray-scale data stored in said line memory and, when both of them are matched with each other, to output said matching signal, and a data output controller to stop outputting of gray-scale data responsive to the match and non-match of said matching signal and to produce said gray-scale data.

19. An image display device comprising:

a display panel in which a pixel electrode is arranged at every point of intersections of scanning lines and signal lines;

a display controller to output, sequentially and in parallel, digital gray-scale data for every "i" sets of said digital gray-scale data being input successively;

a scanning line driver to sequentially scan a scanning line on each of rows in every scanning period;

a signal line driver to generate a signal voltage responsive to the parallel gray-scale data and to feed it for every corresponding "i" sets of signal lines;

wherein said display controller has a gray-scale data comparison controller which produces a matching signal indicating an exact match or non-match obtained by a result from comparison between "i" sets of input gray-scale data and "i" sets of gray-scale data provided one scanning period before and exerts control so as to output "i" sets of gray-scale data when said matching signal indicates the non-match and to stop outputting said "i" sets of gray-scale data when said matching signal indicates the exact match; and wherein said signal line driver is so configured as to latch, when said matching signal indicates non-matching, "i" sets of input gray-scale data in response to a latch pulse providing driving timing of said "i" sets of signal lines and so as to produce a signal voltage using said gray-scale data unmodified by said gray-scale data from one scanning period before and, when said matching signal indicates the exact match, to output a signal voltage based on "i" sets of gray-scale data latched during said scanning period.

20. The image display device according to claim 19, wherein said gray-scale data comparison controller comprises a line memory to hold said input gray-scale data and to output it one scanning period later, a comparator to compare said input gray-scale data with output gray-scale data stored in said line memory and, when both of them are matched with each other, to output said matching signal, and a data output controller to stop or perform outputting gray-scale data responsive to the match and non-match of said matching signal.

21. An image display device comprising:

a display panel in which a pixel electrode is arranged at every point of intersections of scanning lines and signal lines;

a display control circuit to sort digital gray-scale data so as to correspond to a pixel arrangement in said display panel and to output the sorted digital gray-scale data;

a scanning line driving circuit to sequentially scan said scanning line on each of rows in every scanning period; and a signal line driving circuit to generate a signal voltage responsive to the sorted gray-scale data for each of the signal lines and to feed a produced signal voltage to a corresponding signal line on each column in every scanning period;

wherein said display control circuit produces a matching signal indicating an exact match or non-match obtained by a result from comparison between a present row of gray-scale data to be provided for a present scanning line during a present scanning period and a preceding row of gray-scale data provided for a preceding scanning line during an immediately preceding scanning period and exerts control so as to output the present row of gray-scale data to said signal line driving circuit when the matching signal indicates the non-match and not to output the present row of gray-scale data but to output said matching signal to said signal line driving circuit when the matching signal indicates the exact match, said display control circuit comprising a line memory to hold an input gray-scale data as the preceding gray-scale data to be compared only during one scanning period; and wherein said signal line driving circuit is configured to latch, when the matching signal indicates the non-match, the present row of gray-scale data in response to a latch pulse providing driving timing of each of said signal lines and to produce and output a signal voltage based on the latched present row of gray-scale data, and, when the matching signal indicates the exact match, to output a signal voltage based on the preceding row of gray-scale data latched during the immediately preceding scanning period.

* * * * *